US009835176B2

(12) United States Patent
Hustvedt

(10) Patent No.: US 9,835,176 B2
(45) Date of Patent: Dec. 5, 2017

(54) FAN INLET AIR HANDLING APPARATUS AND METHODS

(71) Applicant: Acoustiflo, LLC, Boulder, CO (US)

(72) Inventor: David Charles Hustvedt, Boulder, CO (US)

(73) Assignee: AcoustiFLO LLC, Boulder, CO (US)

( * ) Notice: Subject to any disclaimer, the term of this patent is extended or adjusted under 35 U.S.C. 154(b) by 850 days.

(21) Appl. No.: 14/245,947

(22) Filed: Apr. 4, 2014

(65) Prior Publication Data

US 2015/0104294 A1 Apr. 16, 2015

Related U.S. Application Data

(60) Provisional application No. 61/809,261, filed on Apr. 5, 2013.

(51) Int. Cl.
*F04D 29/66* (2006.01)
*F04D 29/70* (2006.01)

(52) U.S. Cl.
CPC ..... *F04D 29/665* (2013.01); *F04D 29/663* (2013.01); *F04D 29/667* (2013.01); *F04D 29/703* (2013.01)

(58) Field of Classification Search
CPC .... F04D 29/665; F04D 29/667; F04D 29/541; F04D 29/663; F04D 29/703; F24F 7/06; F24F 13/10
See application file for complete search history.

(56) References Cited

U.S. PATENT DOCUMENTS

D144,034 S 3/1946 Budlong
D182,209 S 2/1958 Stanley
3,096,080 A * 7/1963 Willems ..... G10K 7/005 116/137 A
D201,322 S 6/1965 Knapp
3,485,443 A 12/1969 Walter
3,980,912 A 9/1976 Panza
4,077,206 A 3/1978 Ayyagari
4,174,020 A 11/1979 Challis
(Continued)

FOREIGN PATENT DOCUMENTS

DE 2778432 B1 * 10/2015 ..... F04D 29/541

OTHER PUBLICATIONS

EP 2778432 B1 English Translation.*

*Primary Examiner* — Mark Laurenzi
*Assistant Examiner* — Shafiq Mian
(74) *Attorney, Agent, or Firm* — Santangelo Law Offices, P.C.

(57) ABSTRACT

Particular embodiments of the inventive technology may be described as an air handling shroud for establishment at the inlet area of a fan, the shroud adapted to realign and/or redistribute fan inlet flow so as to reduce fan-generated noise without unacceptably impairing fan efficiency and/or performance. Certain embodiments present a lattice arrangement of cells through which air flows; the shroud may protrude up from an inlet face lying in a plane defined by the fan (e.g., by the fan housing or an inlet cone). It may have a hemispherical shape and a lower resistance-per-area sector at the pole (or polar region) thereof. Optional componentry includes but is not limited to a flow obstructer established at a fan proximal portion of the shroud, and acoustic material established on surfaces of the cells of the shroud.

14 Claims, 13 Drawing Sheets

(56) References Cited

U.S. PATENT DOCUMENTS

| | | | | |
|---|---|---|---|---|
| 4,279,325 | A | 7/1981 | Challis | |
| D313,468 | S | 1/1991 | Chaney | |
| 5,088,886 | A | 2/1992 | Hopkins | |
| 5,124,600 | A | 6/1992 | Hedeen | |
| 5,279,515 | A | 1/1994 | Banta et al. | |
| 5,336,046 | A | 8/1994 | Fujino et al. | |
| 5,502,869 | A | 4/1996 | Arnold et al. | |
| 5,508,477 | A | 4/1996 | Kato et al. | |
| 5,526,228 | A | 6/1996 | Dickson et al. | |
| D386,579 | S | 11/1997 | Jane' et al. | |
| D391,359 | S | 2/1998 | Teng et al. | |
| D394,521 | S | 5/1998 | Caya | |
| D400,544 | S | 11/1998 | Allen | |
| D420,442 | S | 2/2000 | Brewer | |
| D427,674 | S | 7/2000 | Moreno | |
| D429,328 | S | 8/2000 | Hotaling et al. | |
| 6,104,608 | A | 8/2000 | Casinelli et al. | |
| D432,742 | S | 10/2000 | Puigcerver et al. | |
| D459,468 | S | 6/2002 | Moreno | |
| D460,978 | S | 7/2002 | Toste et al. | |
| D471,971 | S | 3/2003 | Hurlstone et al. | |
| D480,710 | S | 10/2003 | Rivera | |
| D481,790 | S | 11/2003 | Moreno | |
| D482,779 | S | 11/2003 | Shapiro | |
| D483,028 | S | 12/2003 | Morrow, Jr. et al. | |
| D488,861 | S | 4/2004 | Moreno | |
| D492,402 | S | 6/2004 | Shapiro | |
| 6,896,095 | B2 | 5/2005 | Shah et al. | |
| D513,437 | S | 1/2006 | Wilhelm | |
| 7,172,387 | B2 * | 2/2007 | Yamamoto | F04D 29/703 415/119 |
| D582,541 | S | 12/2008 | Lai | |
| D586,456 | S | 2/2009 | Guthrie | |
| D615,557 | S | 5/2010 | Mayer et al. | |
| 7,856,837 | B2 | 12/2010 | Yamashita et al. | |
| 8,033,358 | B2 | 10/2011 | Ivers | |
| D650,225 | S | 12/2011 | Bartol et al. | |
| 8,182,218 | B2 * | 5/2012 | Pearce | F04D 29/703 415/220 |
| 8,376,884 | B2 * | 2/2013 | Spaggiari | B60H 1/00464 474/184 |
| D681,799 | S | 5/2013 | Pan | |
| D695,059 | S | 12/2013 | Mehler et al. | |
| D699,834 | S | 2/2014 | Pan | |
| D729,449 | S | 5/2015 | Sayers et al. | |
| 9,097,261 | B2 | 8/2015 | Haaf | |
| D761,412 | S | 7/2016 | Strehle et al. | |
| D764,652 | S | 8/2016 | Weiss et al. | |
| 9,494,162 | B2 | 11/2016 | Haaf et al. | |
| D775,321 | S | 12/2016 | Haaf et al. | |
| D775,721 | S | 1/2017 | Muller et al. | |
| D776,250 | S | 1/2017 | Muller et al. | |
| D782,645 | S | 3/2017 | Haag et al. | |
| 2005/0271516 | A1 * | 12/2005 | Chang | F04D 29/703 416/247 R |
| 2006/0013694 | A1 * | 1/2006 | Eubank | F04D 29/703 416/247 R |
| 2007/0104569 | A1 | 5/2007 | Tsai | |
| 2007/0214956 | A1 | 9/2007 | Carlson et al. | |
| 2009/0180877 | A1 * | 7/2009 | Lin | F04D 25/0613 416/62 |
| 2009/0208353 | A1 * | 8/2009 | Weiser | A63H 3/003 417/410.1 |
| 2010/0329857 | A1 | 12/2010 | Heli et al. | |
| 2011/0017427 | A1 * | 1/2011 | Kato | F04D 29/164 165/59 |
| 2011/0150632 | A1 | 6/2011 | Heli et al. | |
| 2012/0156064 | A1 * | 6/2012 | Birdsell | F04D 25/105 417/374 |
| 2012/0205350 | A1 * | 8/2012 | Stadtmueller | B23K 26/046 219/121.64 |
| 2013/0017073 | A1 | 1/2013 | Sauer et al. | |
| 2013/0045085 | A1 | 2/2013 | Frank et al. | |
| 2013/0302153 | A1 | 11/2013 | Liu | |
| 2014/0053793 | A1 | 2/2014 | Sullivan et al. | |
| 2014/0154095 | A1 * | 6/2014 | Gonz Lez | F24F 1/06 416/247 R |
| 2014/0209275 | A1 | 7/2014 | Schone et al. | |

* cited by examiner

FAN INLET AIR HANDLING APPARATUS AND METHODS

This US non-provisional application claims priority to U.S. Provisional App. No. 61/809,261, filed Apr. 5, 2013, said provisional application incorporated herein by reference in its entirety.

BACKGROUND

Fans, whether applied in an industrial, residential, or other setting, generate noise during operation. Not only can a motor powering a fan generate noise, but the interaction of the air moved by the fan with the fan blades (e.g., the impact between the air and the fan blades), can also generate noise. At times, fan noise is not problematic—for example, even significant amounts of noise in an industrial setting may be of no concern. But at other times, and perhaps in other applications, fan noise is problematic, and a reduction, or attenuation thereof, may afford benefits to those in the area of the fan. More particularly, those within "aural" range of the fan may find a reduction in fan noise reduces disturbance caused by the fan. Even where a fan generated noise is at a low enough level such that one may become accustomed to, and not disturbed by the fan during its operation, the abrupt change from no fan noise to fan noise that takes place during activation of the fan (i.e., "turning on") of the fan may make a noise level that is otherwise sufficiently low, problematic.

Benefits other than human disturbance mitigation may also flow from reduction, or even elimination of fan noise—improvement in security (certain applications may benefit if individuals are not given aural clues as to the location of a fan (and perhaps equipment it may cool) and/or when it turns on and off); and mitigation of disturbance to wildlife and/or animals. These are just a few of possibly many benefits of reducing (which includes eliminating) fan noise achieved by embodiments of the inventive technology. Note that the inventive technology disclosed herein does not focus on reduction of fan motor generated noise, but instead on reduction of that component of fan noise that is attributable to the movement of air by the fan blades (e.g., by the impact of the air with the fan blades).

While there have been attempts to mitigate fan noise—see, e.g., U.S. Pat. No. 5,088,886—any success has not been without an unacceptably high reduction in some measure of fan performance and/or fan efficiency. Particular embodiments of the inventive technology offer advantages over conventional approaches in that the reduction in noise achieved by embodiments of the inventive technology comes with either no impact on relevant fan performance/efficiency metric(s), or an acceptably small impact on such metric(s).

It is a goal of certain embodiments of the inventive technology to offer a shroud for the inlet area of a fan and to act on inlet air that is moved by the fan, in order to reduce noise of that fan during operation thereof.

It is one goal of certain embodiments of the inventive technology to offer a shroud that may be retrofitted onto an existing fan in order to act on fan inlet air, upon attaching that shroud to the fan (which includes but is not limited to apertured plating, casing, inlet cone, fan housing of any sort, supports for the fan, etc.). Note that certain embodiments of the inventive technology may find application attached to any sort of inlet cone (including but not limited to, e.g., 27004 inlet cone, and the 686qi011, an ideal hyperbolic curve inlet cone).

It is one goal of certain embodiments of the inventive technology to offer a shroud and a fan (whether attached to the fan or as part of a kit that includes the fan and the shroud) available for purchase; the shroud would be suited for use on that fan (e.g., perhaps because it is attachable in some manner to that fan). It is of note that the term fan as used herein may include, but is not limited to, the fan blades, and any motor, casing or housing therefor, in addition to inlet cones.

It is one goal of certain embodiments of the inventive technology to offer apparatus (and associated methods) that reduce fan noise while not unacceptably impairing relevant fan performance and/or efficiency metric(s).

It is one goal of certain embodiments of the inventive technology to offer apparatus (and associated methods) to realign fan inlet flow so that overall it has a greater component that is parallel with (which includes co-linear with) the fan rotation axis, as compared to the case where the inventive apparatus is absent (i.e., not attached to the fan or configured to act on the fan's inlet air).

It is one goal of certain embodiments of the inventive technology to offer apparatus (and associated methods) to redistribute fan inlet flow by increasing the portion thereof that enters a lower resistance sector that his substantially centered around and substantially at a "pole" of the inlet flow area. In such manner, the overall fan inlet flow may have a greater component thereof that is parallel with the fan rotation axis.

It is a goal of certain embodiments of the inventive technology, upon application in a noise limited environment, to allow for greater air moving operation (e.g., fan operation at higher speeds), perhaps to achieve a cooling or other operational goal, while still staying at or below the fan noise limit.

It is one goal of certain embodiments of the inventive technology to offer apparatus (and associated methods) that reduce fan-noise induced disturbance (and associated impacts of fan noise) to individuals in a fan area, without impairing any relevant fan performance and/or efficiency parameter to an unacceptable degree.

It is one goal of certain embodiments of the inventive technology to offer apparatus (and associated methods) to achieve noise reduction and fan performance/efficiency-related goals while minimizing materials and manufacture cost of the inventive apparatus.

It is one goal of certain embodiments of the inventive technology to offer apparatus (and associated methods) that are customized for a given fan application(s).

Of course, other goals, benefits, and advantages of the inventive technology may be disclosed elsewhere in this specification, including the drawings, claims, and written description.

Figure 1:
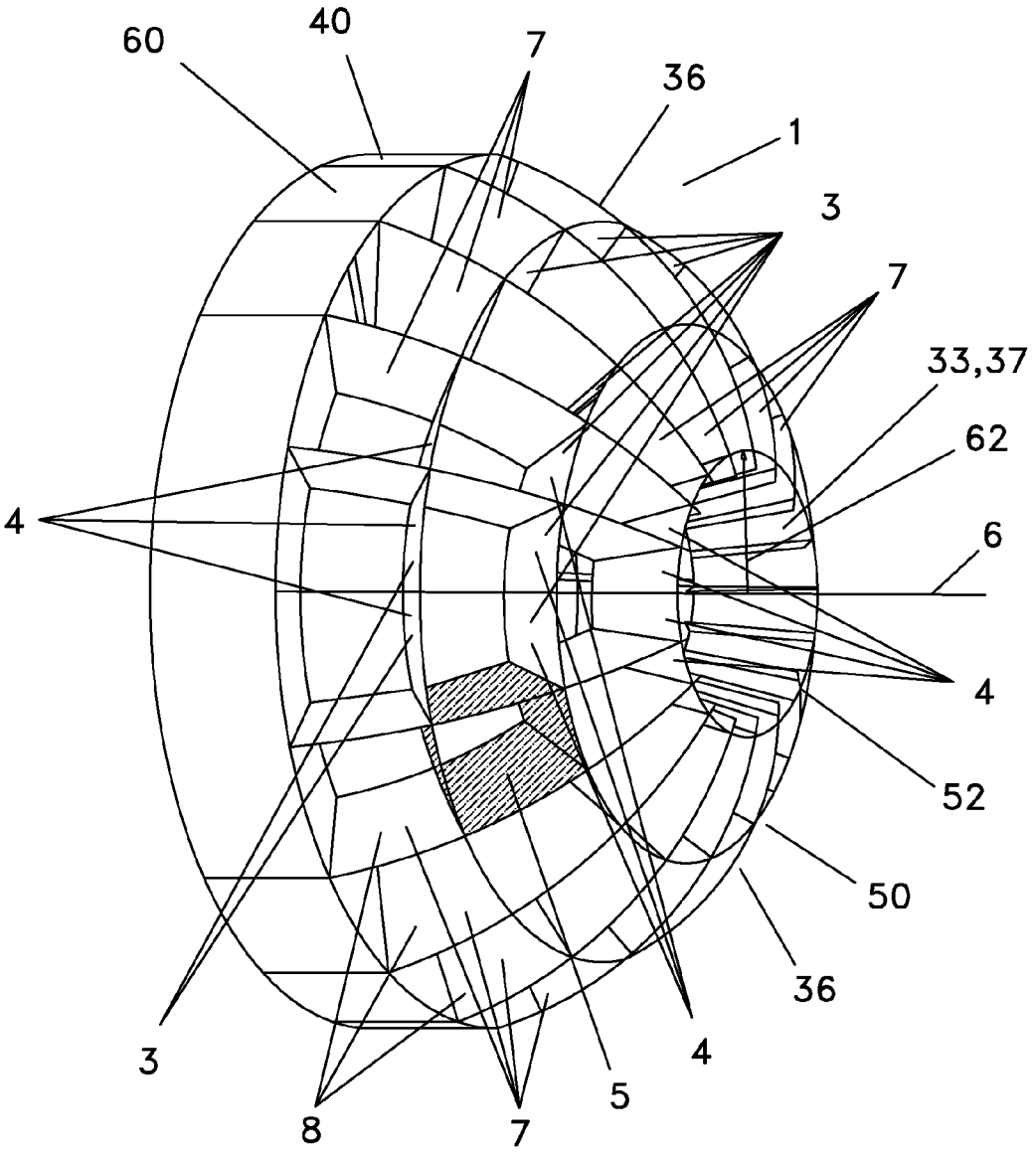
FIG. 1 shows a perspective view of an embodiment of the inventive technology, from outside of it, unattached to a fan.
Figure 2:
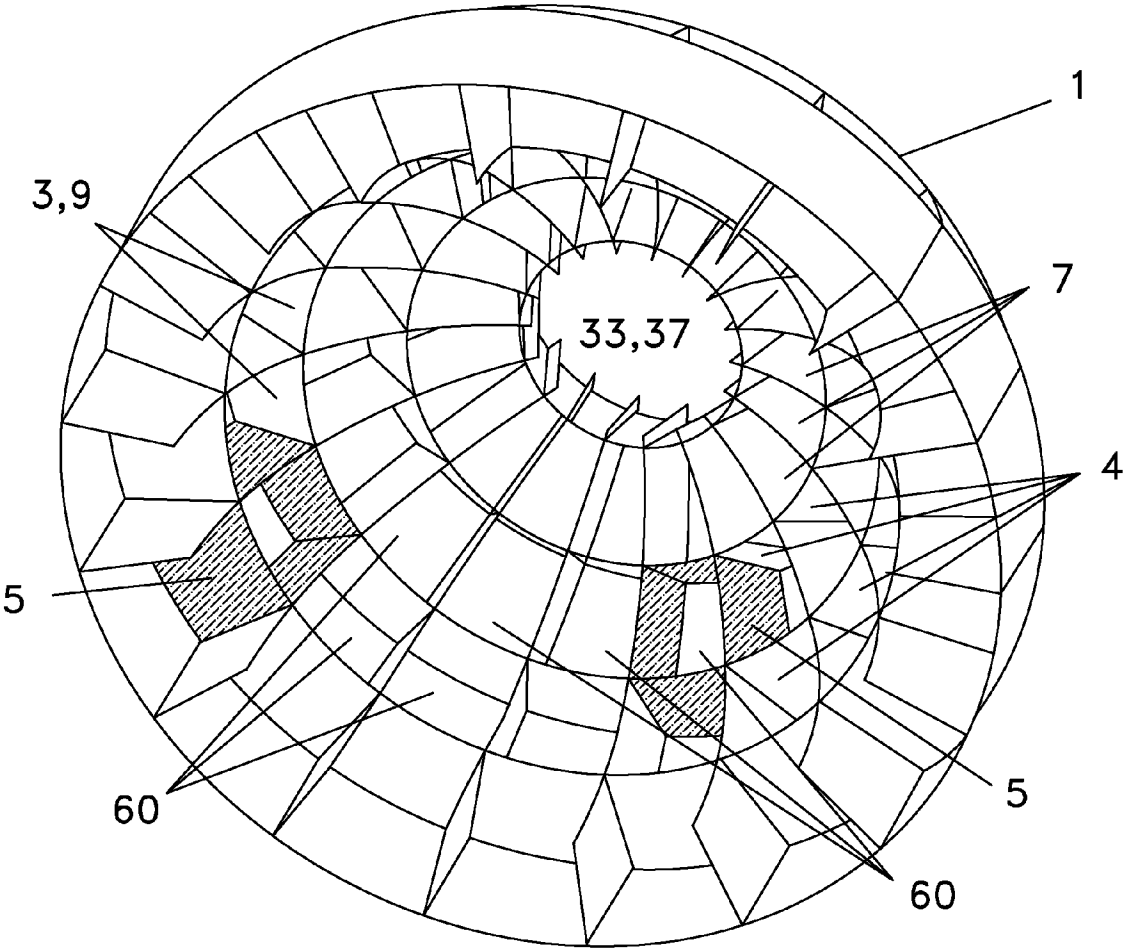
FIG. 2 shows a perspective view of an embodiment of the inventive technology, from below it, unattached to a fan.
Figure 3:
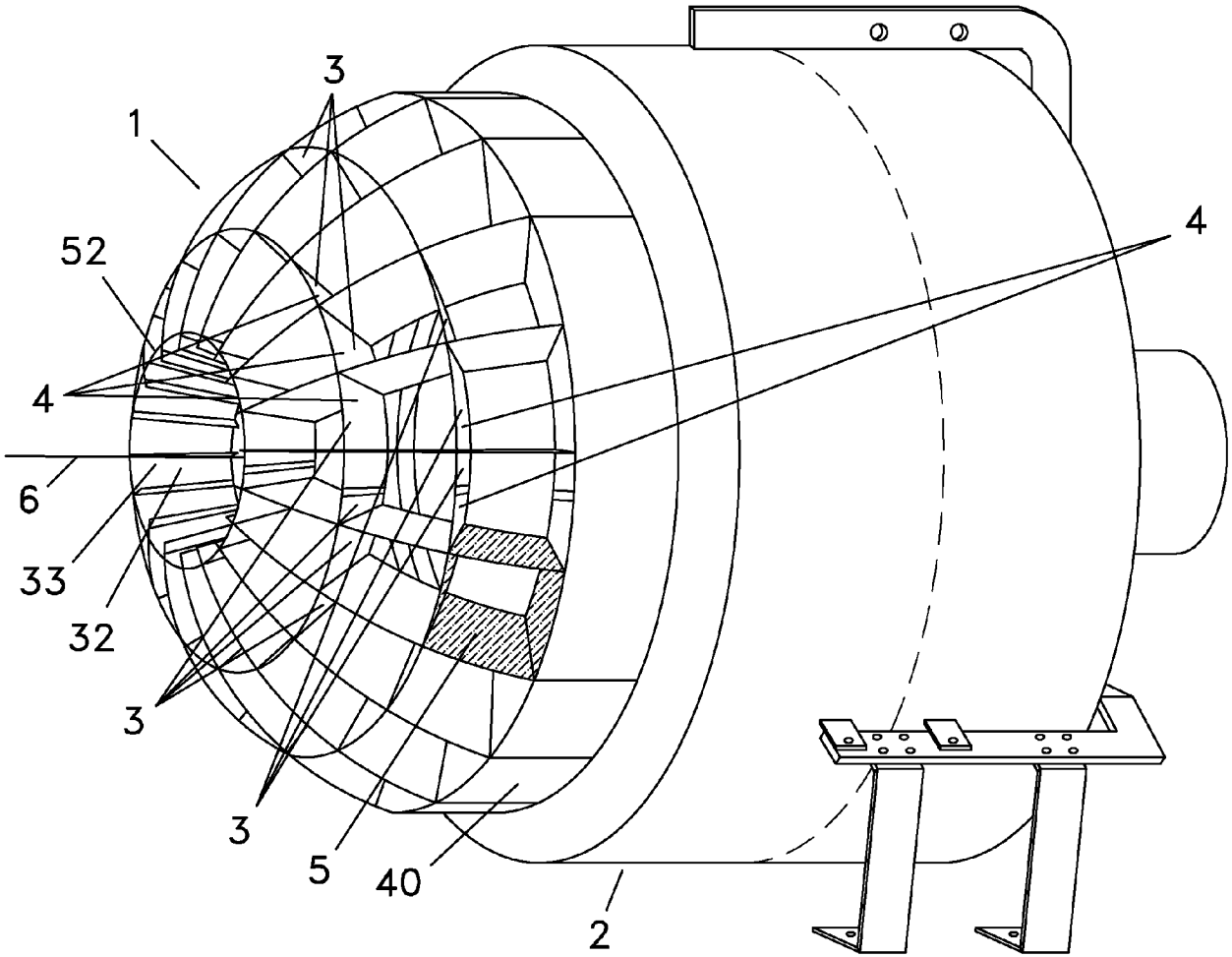
FIG. 3 shows a perspective view of an embodiment of the inventive technology attached to a fan.

Note that it is not the case that all instances of a given component are called out with reference numbers in the figures. Also, note that the drawings merely show possible examples of particular embodiments of the inventive technology and do not limit its scope.

DESCRIPTION OF THE PREFERRED EMBODIMENTS

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

At least one embodiment of the inventive technology may be described as an inlet flow realignment shroud 1 for a fan 2, the shroud comprising: a plurality of flow deflectors 3, each having a flow deflect surface 4 (that flow impacts and that diverts such impacted flow, thereby re-aligning it as desired), and each established in a locationally different, respective flow realignment cell 5 [which includes structure (e.g., flow deflector and support therefor), where such structure realigns flow as desired], wherein each the flow realignment cell is upflow of a fan rotation plane 20 (i.e., the plane in which the fan blades move, and relative to which the fan rotation axis is perpendicular) and radially outward from a fan rotation axis 6 (note also that different cells may be differently located relative to at least one of: distance upflow from fan along fan rotation axis; radial outward distance from fan rotation axis; and angular orientation, with vertex on the fan rotation axis, in a plane that is parallel with the fan rotation plane). A different portion of the fan intake flow passes through each cell during fan operation (indeed, in preferred embodiments each cell defines an opening 60 through which flow may pass). Each flow realignment cell 5 may include a flow deflector 3 (or flow re-aligner, because it re-aligns flow) of sorts; the shroud 1 effects realignment of a portion of the fan input flow using physical structure that makes up the cell. The shroud may further include flow deflector supports 7 (including but not limited to support ribs 8 that perhaps are established longitudinally) that support the flow deflectors, wherein the flow deflectors each deflect incoming flow so that it is more closely aligned with the fan rotation axis; such supports may form part of the cell. Note that there may be many cells (e.g., from one to 20, 21-50, 51-200, 201-500, 501-1000, or more than 1000) within a single shroud. There may be similar numbers of flow deflectors; while there is typically one flow deflector per cell, this is not a required feature of the inventive technology. Note also that in particular embodiments (e.g., see FIG. 1), a flow deflector may be the entire two sided component having perhaps only one side that is the flow deflect surface. Note that only a few of the several flow realignment cells shown in the figures (see, e.g., FIGS. 1-5) are called out with a reference number (number 5). Note also that the cells that are called out are shaded, merely to clarify which components are parts of the single identified cell.

Figure 6:
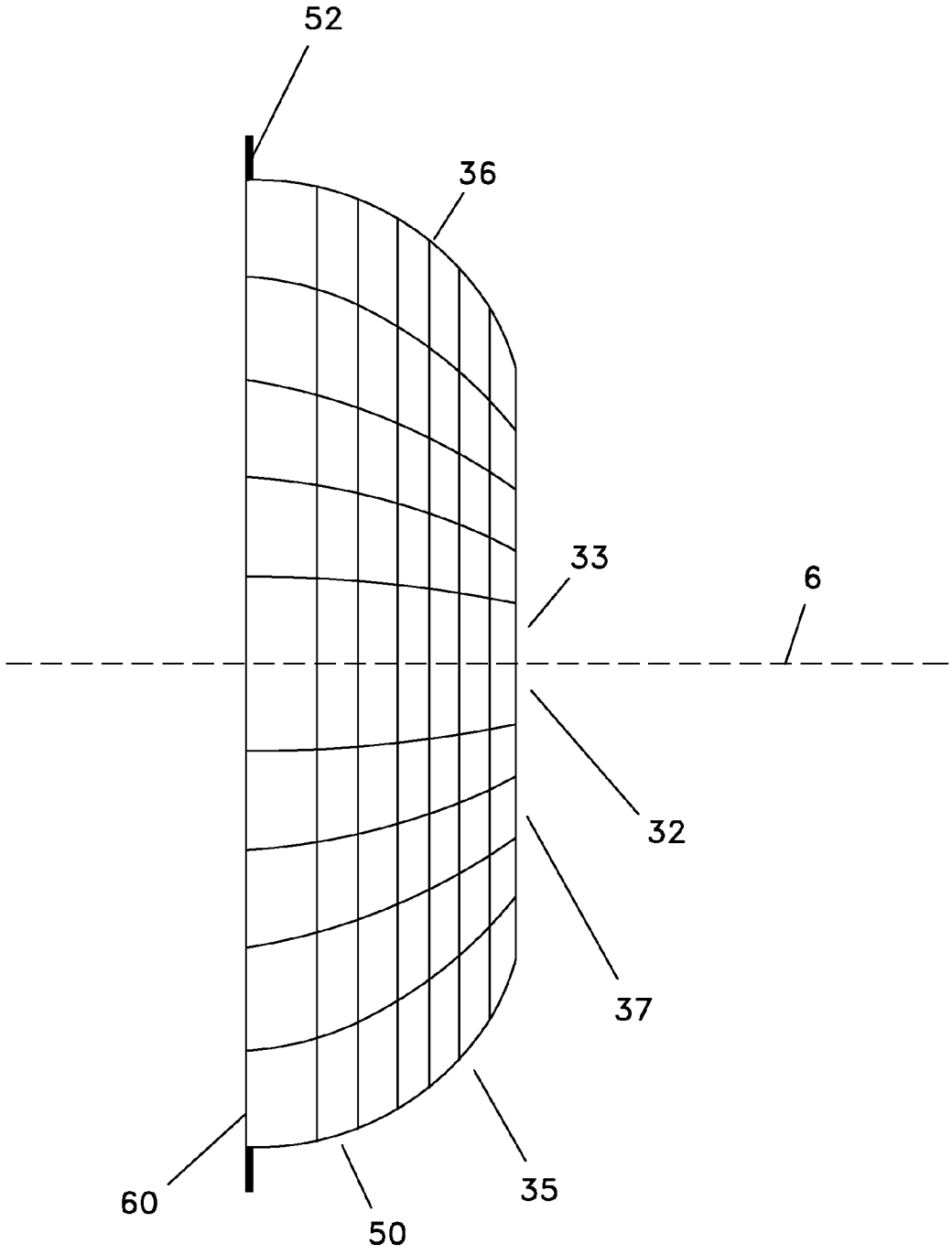
FIG. 6 shows a side view of an embodiment of the inventive technology (note that only the outer surface thereof is shown).
Figure 9A:
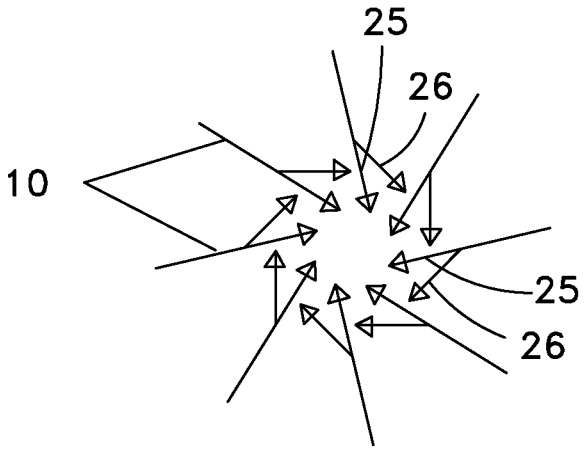
FIG. 9A shows a cross-sectional view (in a plane that is orthogonal to the axis of fan rotation) of an embodiment of the inventive technology. It shows radial direction flow deflectors, and vectors of re-directed flow (realigned flow) as compared with flow vectors of flow as it would appear in the absence of the inventive apparatus; vectors start at the innermost point of the deflectors.
Figure 9B:
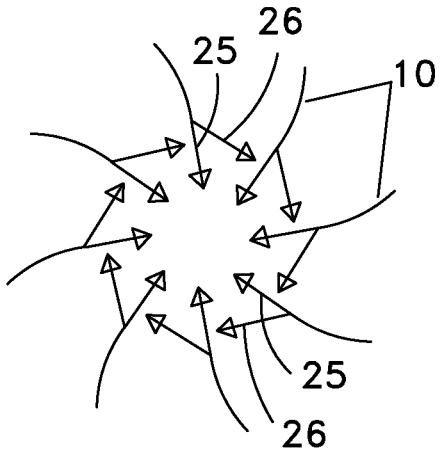
FIG. 9B shows a cross-sectional view (in a plane that is orthogonal to the axis of fan rotation) of an embodiment of the inventive technology. It shows radial direction flow deflectors that are curved, and vectors of re-directed flow (realigned flow) as compared with flow vectors of flow as it would appear in the absence of the inventive apparatus; vectors start at the innermost point of the deflectors.
Figure 9C:
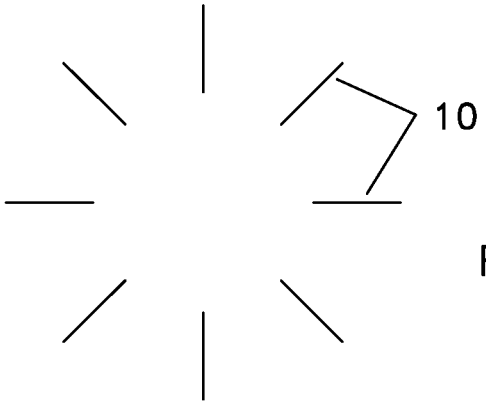
FIG. 9C shows a cross-sectional view (in a plane that is orthogonal to the axis of fan rotation) of an embodiment of the inventive technology. Note that even these entirely radially aligned structures may serve to better align (make "more radial") flow that exhibits swirl.
Figure 10:
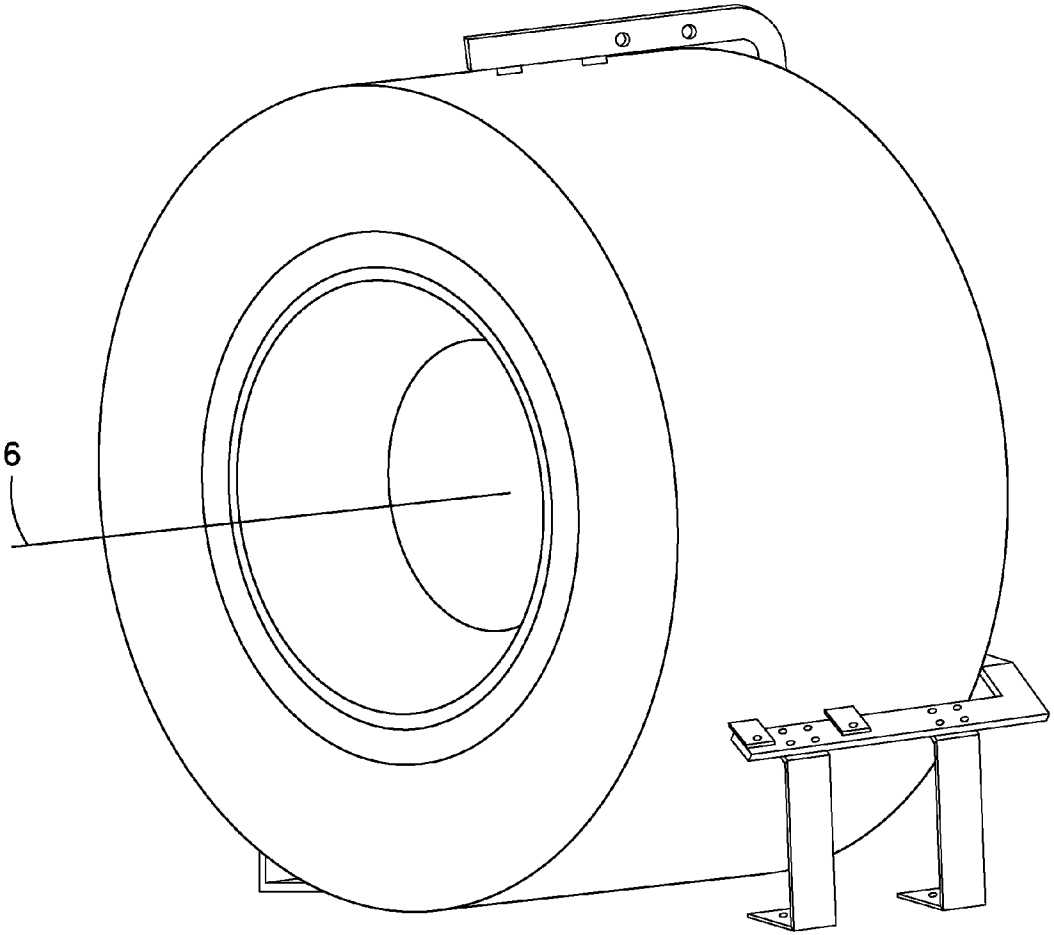
FIG. 10 shows a fan. It is an example of one of the many different types and designs of fans to which the inventive technology may be applied.

Note that the flow deflectors may be either axial direction flow deflectors 9 (because they deflect flow so as to increase its component that is parallel with the axis of fan rotation) as shown in FIG. 1, (in applications without swirl) or radial direction flow deflectors 10 (because they deflect flow so as to increase its component that is parallel with a radius emanating from and normal to the axis of fan rotation; see FIGS. 9A, 9B and 9C). Note that whether a structure is a flow deflector or not may depend on the application (for example, if there is no swirl induced by a fan in a particular application, there is no need for radial direction flow deflection by a shroud; however, that same shroud may indeed effect radial direction flow deflection in a different application that does suffer from swirl). Even radially disposed structures may act as radial direction flow deflectors (see, e.g., FIG. 9C). Some embodiments may include both axial direction and radial direction flow deflectors; some may include only one or the other (see, e.g., FIG. 1, which, in applications without swirl, shows a shroud with only axial direction flow deflectors). And some other embodiments, as will be explained below and as shown generally in FIG. 6, include no flow deflectors (but achieve goals of the inventive technology merely by creating a zone of increased resistance to fan input flow in a general area that is proximate the fan, thereby increasing fan input flow that is naturally more parallel with the fan rotation axis, at and/or beyond the most distal portions of the shroud's physical structure). Note that a structure that is oriented such that the drag it causes is minimal is not considered a flow deflector. Note that the term shroud is a broad term and generally includes any structure that allows passage of flow through it. The terms latticed apparatus has a similar meaning when established relative to the inlet of a fan; it also includes any structure that allows flow therethrough, regardless of the grid pattern.

Figure 7:
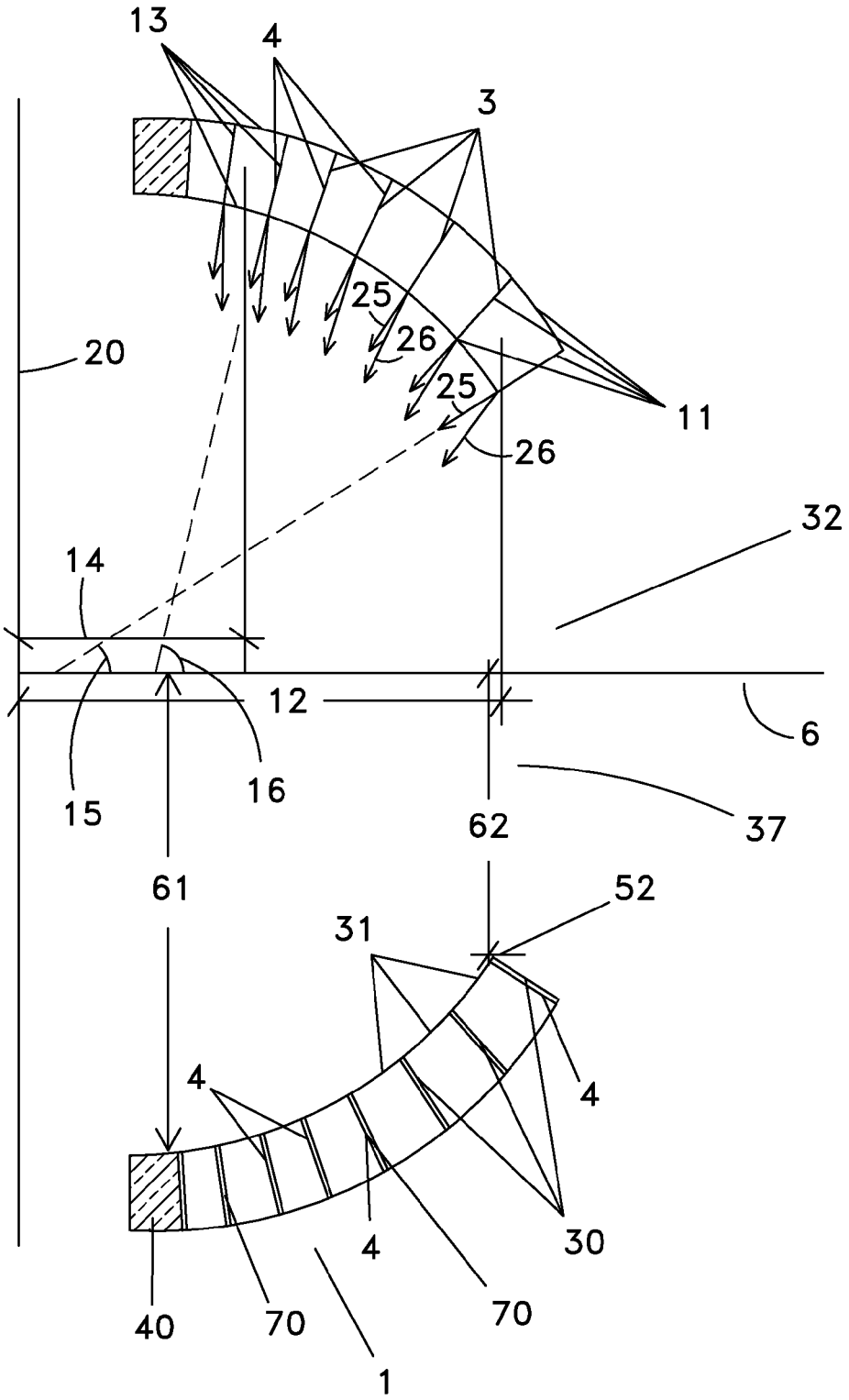
FIG. 7 shows a cross-sectional view (in a plane that contains the axis of fan rotation) of an embodiment of the inventive technology. Note that, for clarity purposes, acoustic material is shown only on the lower half of the cross-sectional view.
Figure 8:
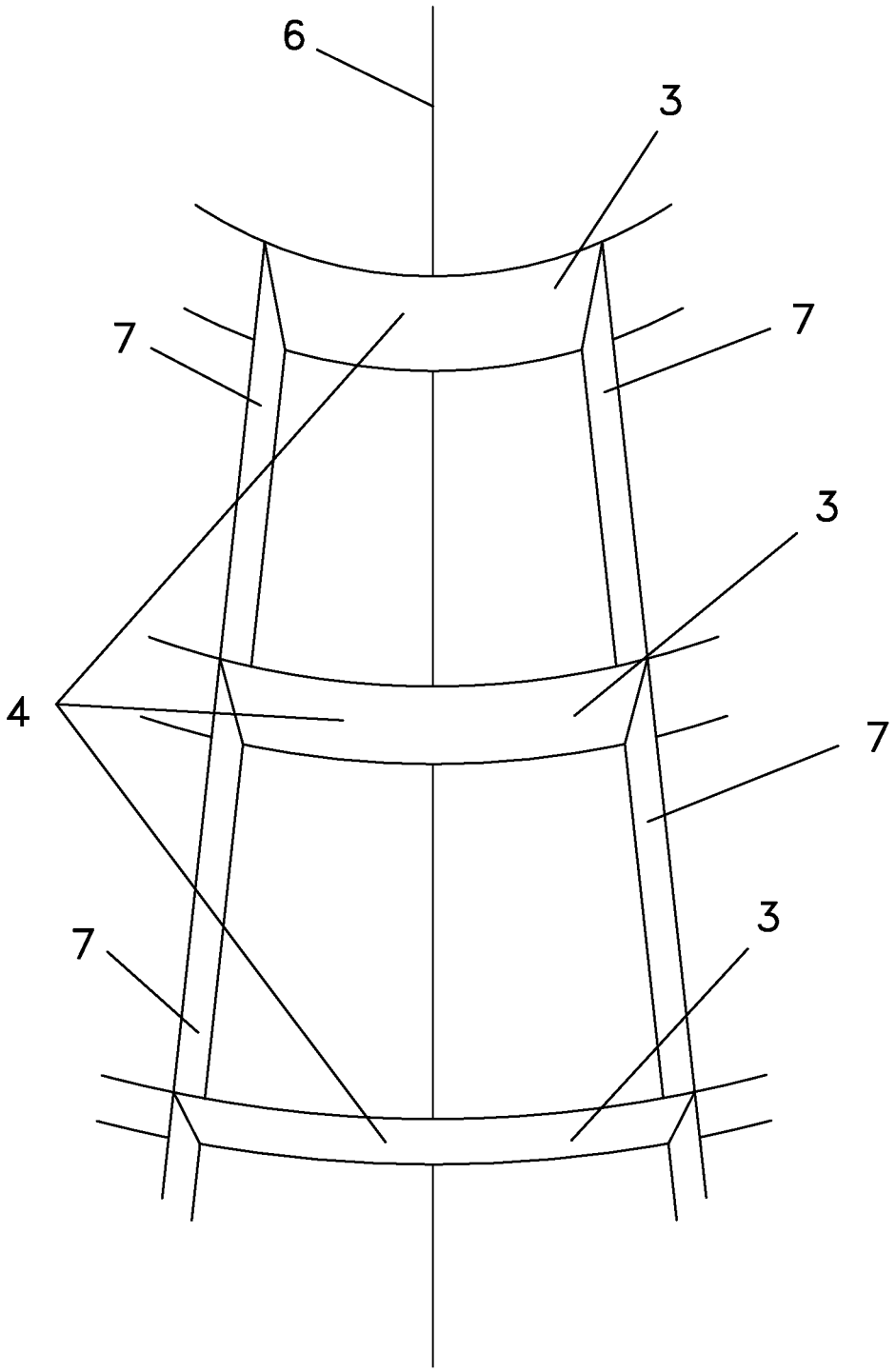
FIG. 8 shows a view from outside of a shroud of two cells as they may appear in an embodiment of the inventive technology.

At least one of the flow deflectors in a shroud may be termed an axially distal flow deflector 11 (distal, and proximal, are relative to the fan rotation plane) and is in a respective flow realignment cell that is radially outward from a point on the fan rotation axis that is an axially distal deflector distance 12 from the fan rotation plane, and at least one of the flow deflectors is an axially proximal flow deflector 13 and is in a respective flow realignment cell that is radially outward from a point on the fan rotation axis that is an axially proximal distance 14 from the fan rotation plane. Of course, the axially distal deflector distance is greater than the axially proximal distance; both are measured along the fan rotation axis from the center of the fan blades themselves). Note that one shroud may have several sets of deflectors that meet this criterion. FIG. 7 shows exemplary axially distal and axially proximal flow deflectors 11 and 13. The axially distal flow deflector 11, particularly if it is an axial direction flow deflector (as shown in FIG. 7), may have a respective flow deflect surface 4 that forms a characteristic axially distal flow deflector angle 15 with the fan rotation axis, while the axially proximal flow deflector (again, particularly if it is an axial direction flow deflector) has a respective flow deflect surface 4 that forms a characteristic axially proximal flow deflector angle 16 with the fan rotation axis; in particular embodiments, the characteristic axially distal flow deflector angle 15 is less than the characteristic axially proximal flow deflector angle 16. This conforms with flow lines that are expected (flow that is closer to the fan rotation plane tends to have a greater relative radial component and a smaller relative axial component while flow further from the fan rotation plane has a smaller relative radial component and a greater relative axial component). The term characteristic (angle) is used to account for curved deflector surfaces (whose characteristic angle would be the tailing edge angle of the deflector surface, because such angle is the angle of the realigned flow); of course, flat, non-curved surfaces have a characteristic angle also.

As alluded to above, the differences in characteristic angles of flow deflect surfaces relate to the fact that each such deflect surface may be oriented (e.g., angled) depending on where on the shroud it appears. More particularly, the closer it is to the fan rotation axis, the greater the angle such surface may make with the fan rotation axis (note that such angles are measured such that angle opens away from the fan rotation axis, so that the angles are acute). This conforms with directional fan input flow patterns that one expects—the further the fan input flow is from the fan rotation axis, the greater the component of that flow that is parallel with the fan rotation axis. Certain embodiments, in order (if intended) to divert flow through all sectors of the shroud a substantially equal amount, may feature flow deflect surfaces that are oriented (angled relative to the fan rotation axis) so as to have characteristic angles that are slightly less (perhaps by substantially equal amounts), such as 3-15 degrees in certain merely exemplary embodiments, than angles of corresponding flow lines that would be observed in the absence of a shroud (i.e., non-deflected input flow angles). Typically, the greater the deviation of the respective deflect surface's angle from the angular direction of corresponding flowlines that would be observed in the absence of the shroud, the greater the resistance that flow deflector has to flow therethrough. FIG. 7 (for axial direction flow deflectors) and FIGS. 9A and 9B (for radial direction flow deflectors) each show a comparison of deflected flow lines (approximated as vectors 25) with flowlines 26 as they would appear in the absence of flow-deflecting embodiments of the apparatus.

Note that the apparatus components may have any of a variety of shapes. For example, cells may be (in cross-section, when viewed using a line of sight that is outside and normal to the shroud) circular, oval, multi-sided, triangular, square, rectangular (see FIGS. 1 and 4), pentagonal shaped, and/or hexagonal shaped, as but a few of several possible shapes (note that a single shroud may have cells of different shapes). The shroud/latticed apparatus itself may also have any of a variety of shapes, including but not limited to hemispherical (e.g., igloo shape, such as shown in FIG. 1), and cylindrical (see FIG. 4), even where such shapes have or define a hole at an area that is most distal from the fan (as shown in FIGS. 1 and 4).

Certain embodiments having any of such shapes (or indeed other shapes) may be viewed as having certain components established substantially latitudinally 30 (often such components, or perhaps a plane that bisects such components, would each define a plane that is substantially parallel to the fan rotation plane) and certain components established longitudinally 31 (often such components would each define a plane that is substantially normal to the fan rotation plane). Often, in embodiments that seek to deflect, or re-align, flow, the latitudinally established components are the axial flow diverters (and/or as the supports for those designs with radial flow diverters), and the longitudinally established components act as either the supports 7 for the axial flow diverters (and/or as radial flow diverters). Note that a cell may share certain components with another cell (e.g., a left support for a first cell may be a right support for a second, neighboring cell that is left of the first cell). Continuing with the hemisphere analogy (which can be helpful even where the approximate shape is neither hemispherical no partially hemispherical, as with, e.g., a cylinder (or partial cylinder), pyramid, regardless of how many sides, or partial pyramid), some designs may even involve structure that is established at or centered on a "pole" 32 defined by the shroud (the pole would be the sector that is furthest from the fan); this may be a lower resistance-per-area sector 33. Note also, incidentally, that the term radial or radius does not necessarily mandate a circle (indeed, e.g., a hexagon (or other shape) could have a radius; it would be a characteristic radius and would be the radius of a circle having the same area as the hexagon (or other shape)). Further, a radial line merely means a straight line from an object or location to the axis; the object or location need not be on a circle in order to define or have a radial line. The sector may, and indeed in certain preferred embodiments is, a hole (i.e., devoid of structure). Such may be preferred because it results in no resistance posed to flow that, because it is far from the fan itself (or perhaps more particularly, because there are other intake areas that are closer to the fan's plane of rotation), already has a relatively larger component that is parallel to the axis of the fan; the more flow through the pole, the less noise during operation. However, in some other embodiments, even certain structure, if configured properly (e.g., relatively larger openings in a grid pattern of structure) can be established in the lower resistance-per-area sector and can result in a lower resistance-per-area at the pole. Note that, as used herein, the term substantially includes exactly, and deviations from such exactness by up to 10%.

In particular embodiments (e.g., FIGS. 1 and 4), latitudinally arranged structure may define circles that have center on the fan axis of rotation 6. Such structures may define a plurality of circles whose respective radius reduces as distance from the fan (along the fan rotation axis) increases (see, e.g., FIG. 1). Such designs may (perhaps other than at the polar region) mimic the shape of a hemisphere quite closely (see, e.g., FIG. 1). Other designs (e.g., FIG. 4), while still benefiting from a hemisphere analogy), may more closely approximate a cylinder.

Figure 4:
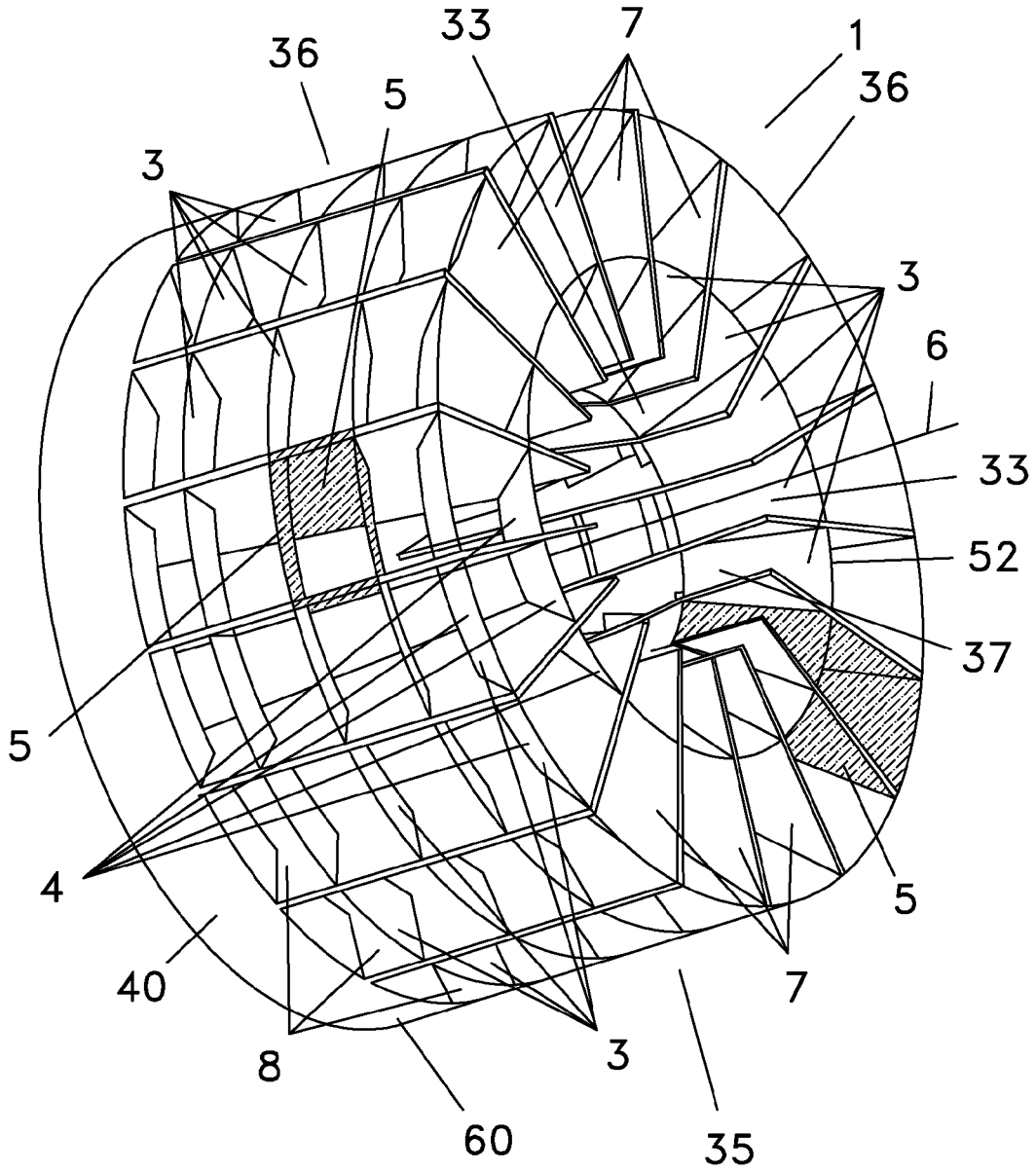
FIG. 4 shows a perspective view of an embodiment of the inventive technology.
Figure 5:
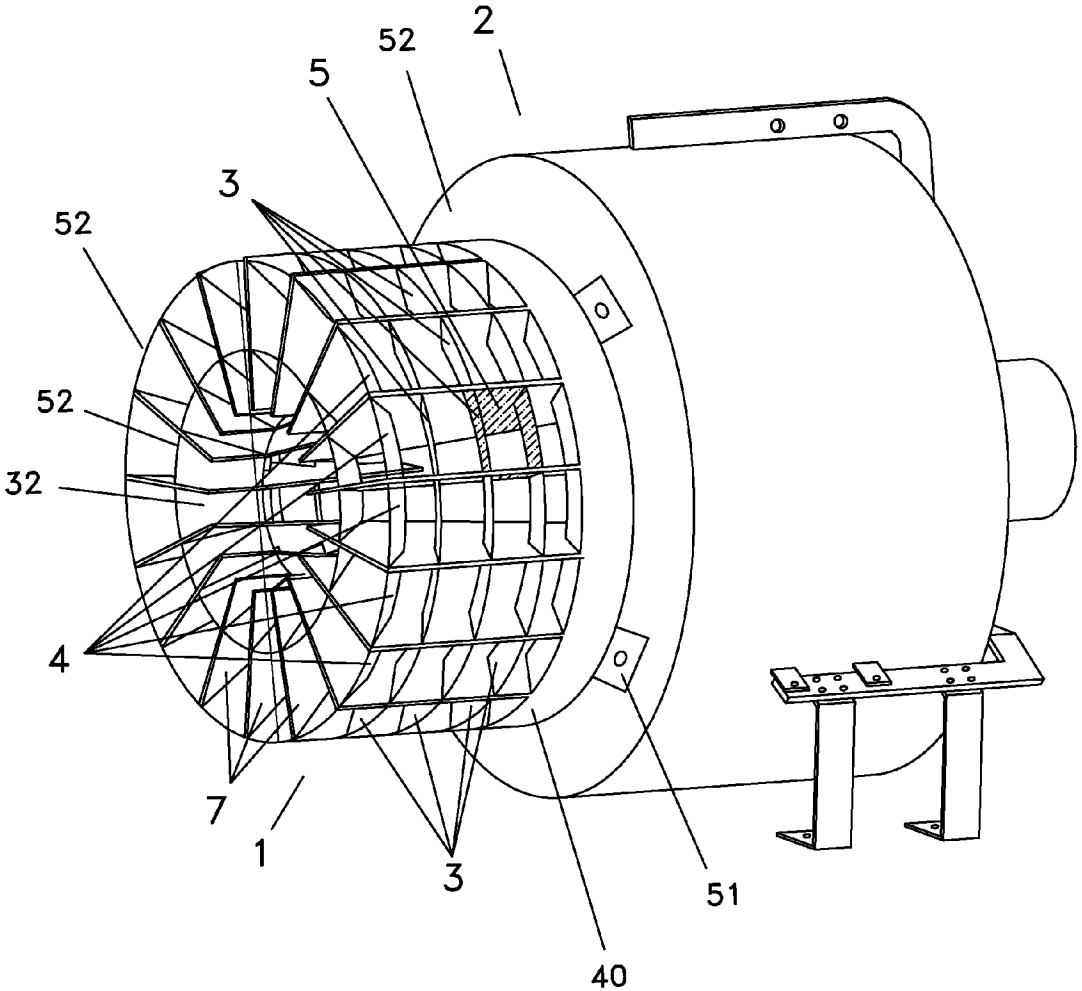
FIG. 5 shows a perspective view of an embodiment of the inventive technology attached to a fan.

In certain embodiments, each locationally different, respective flow realignment cell is defined by at least four distinct surfaces (e.g., distinct surfaces that are disposed in the shape of a box or rectangle open at both ends), where at least one of each of the four surfaces is a flow deflect surface (see, e.g., FIGS. 1 and 4). In particular embodiments, at least some of the flow deflectors are axial direction flow deflectors, meaning that they realign flow coming into the shroud so that its direction, upon leaving the deflector, has a greater axial component. Such axial direction flow deflectors may be established latitudinally.

As also mentioned, certain embodiments may include radial direction flow deflectors, which realign flow coming into the shroud so that, upon leaving the deflector, has a greater radial component (where radial is normal to the fan rotation axis). Such radial direction flow deflectors may be established longitudinally (even where they extend only half way, from pole to equator). FIGS. 9A, 9B and 9C show examples of radial direction flow deflectors. They may act to reduce swirl that exists in fan input flow before it "hits" the shroud (and that would exist, at least unabated, until, and perhaps even after, it hits the fan, in the absence of the shroud, in particular embodiments). Note that swirl may be particularly problematic when wall surfaces in the general inlet area for the fan are asymmetrically disposed around the extended axis of rotation of the fan. Even where the surfaces of such radial direction flow deflectors define planes that are entirely radial (see, e.g., FIG. 9C), such surfaces may indeed effect deflection of flow such that it leaves the surface having a greater radial component, particularly where flow before it hits such surface has a component that, while in a radial plane, is not along a radius (i.e., a radius emanating normally from the fan rotation axis). FIGS. 9A and 9B show a comparison of deflected flow lines (approximated as vectors) with flowlines as they would appear in the absence of flow-deflecting embodiments of the apparatus for radial direction flow deflectors. Note that such radial deflection, when used, may be used in addition to axial direction deflectors, or they may be the only deflectors in the shroud. In other designs, indeed, those designs that are expected to be most common, the axial direction deflectors may be the only deflectors in the shroud.

It is of note that even where a flow realignment cell mentioned above includes, e.g., circular structure (such that air passing through the cell passes through circular structure, such as a cylinder shape that is open at both ends), such structure, in certain embodiments, may still be viewed as including different components, at least one of which may be a flow deflector (having a flow deflect surface). Other components may act to support such flow deflector.

Note that a related manner in which to describe certain aspects of the inventive technology may be as follows: an inlet flow handling shroud for a fan comprising a plurality of flow passage cells established in neighboring fashion so as to extend upstream of a fan and around a fan rotation axis, wherein at least some (or one) of the cells that are furthest from said fan are closer to a fan rotation axis than are cell(s) that are most proximal said fan (when the shroud is attached to the fan). "Furthest" and "closer" may be the distance between the fan rotation plane and the point on the fan rotation axis that is on a line that is normal to that axis and that includes a center of the particular cell. In embodiments where flow realignment is not desired (i.e., perhaps the goal is only to use the shroud to increase resistance to fan inlet air nearer the fan to re-distribute more flow through a lower resistance sector that is further from the fan), the flow passage cells may instead be more generally termed flow realignment cells. A flow realignment cell is a more specific type of flow passage cell. As with any of the various inventive technology disclosed herein, any of the features mentioned herein, or shown in the figures, may optionally be included.

Another related aspect of the inventive technology may be described as follows: a latticed apparatus 35 configured for establishment at an inlet of a fan, the apparatus comprising: a latticed, fan-proximal structure 36 that effects a first resistance-per-area to fan inlet flow passing therethrough and towards the fan, the fan-proximal structure extending upstream or upflow of the fan rotation plane (on the fan air input side) and substantially surrounding a fan rotation axis; and a lower resistance-per-area sector 33 that is further from the fan along the fan rotation axis than is the latticed, fan proximal structure (and thus may be termed a fan distal, lower resistance-per-area sector), the lower resistance-per-area sector characterized by a second resistance-per-area to fan inlet flow passing therethrough and towards the fan, wherein the first resistance-per-area is greater than the second resistance-per-area. Because air flow, like any fluid flow, takes the path of least resistance, establishment of the latticed apparatus in fixed position relative to a fan (e.g., via attachment to the fan or other structure) causes more air to flow through the lower resistance-per-area sector than would be observed through a surface defined by the lower resistance-per-area sector in the absence of the latticed apparatus (of course, such sector does not exist in the case where the latticed apparatus is not in place, so the term "surface defined by" is used instead). In the instant inventive technology, in certain embodiments, this resistance-per-area may be, for example, a drag force (e.g., lbs) per square inch. Such redistributive change in the flow pattern alone may help to achieve one or more goals of the inventive technology. Note that this aspect of the inventive technology may, but need not necessarily, include flow deflectors (whether axial direction deflectors or radial direction flow deflectors). Indeed, particular embodiments may seek to use a flow resisting element such as the latticed, fan-proximal structure to merely to reduce overall radial flow while allowing relatively free axial flow (such as through a pole defined by the apparatus), without deflecting flow (through use of flow deflectors). Optionally, flow deflectors may be used to further realign flow as desired (whether axially and/or radially). Note that the term fan proximal means nothing more than it is closer to a fan (more proximate the fan) than is a different element or sector (which may be referred to as a distal element or sector).

Note that the term lattice refers to any grid type, patterned, meshed, or screened framework through which air may flow. It may, but need not, involve repetitions of identical structure (e.g., a repeated "box" or other cell, even if it changes in size within the apparatus, formed by structure as shown in FIGS.

1, 4 and 6). Note that what the term "resistance-per-area" indicates is different from a total resistance effected by a given structure; the referenced area (in the term "resistance-per-area") is the area that flow is normal to and of a size that corresponds to the referenced item (e.g., the area of the resistance-per-area of a cell is smaller than the area of the resistance-per-area of an entire structure). It may be an average for a certain structure or portion thereof. Note also that the resistance referred to is resistance, i.e., drag force, caused by structure; it does not account for resistance related to dynamic (or shear) viscosity attributable to the fluid itself and viscous forces that portions of it exert on other neighboring portions.

In certain embodiments, the lower resistance-per-area sector 33 includes no structure (i.e., the sector may be a hole 37), and the second resistance-per-area is substantially zero (see, e.g., FIGS. 1, 3, 4 and 6). However, in other embodiments, as mentioned above, there may be some sort of fan-distal structure at the lower resistance-per-area sector (e.g., latticed structure at the pole of the latticed apparatus). Such structure may be established within the lower resistance per area sector 33 and may effect a second resistance-per-area [that perhaps is not substantially zero, but that is still effects a resistance-per-area to flow that is less than the first resistance-per-area (which, again, is effected by the latticed, fan-proximal structure)]. Note that where the lower resistance-per-area sector 33 does have structure, such structure will often have openings (e.g., individual flow areas of individual cells) that are larger (perhaps much larger) than those of the latticed, fan-proximal structure. However, increasing the size of cell openings is not the only way to reduce resistance-per-area. In certain embodiments where the lower resistance-per-area sector does have structure, such structure might be as insignificant as wires, perhaps in a plane that is parallel with the fan rotation axis, that cross from one distal edge of latticed, fan-proximal structure to another, where such wires may provide some form of support for the latticed, fan proximal structure. Of course, a few wires would provide a deminimus amount of resistance to flow.

It should be pointed out that in certain embodiments, the first resistance-per-area to fan inlet flow passing through the latticed, fan proximal structure may be substantially the same at all parts of the structure (e.g., through all cells), but this need not be the case. In cases where the resistance-per-area effected by the fan proximal structure is not uniform, the first resistance-per-area may be an average resistance-per-area for the entire latticed, fan proximal structure. Indeed, in certain embodiments, in order to encourage more flow through cells in the fan proximal structure that are furthest from the fan (and also through the lower resistance sector), and that is therefore more co-linear (with the fan rotation axis), cells of the fan proximal structure that are further from the fan than other cells may intentionally have a lower resistance-per-area to flow. This may be achieved, e.g., via decreasing the depth (i.e., the distance from the outer surface of the cell to the inner surface of the cell) of such cells and/or increasing the opening size of the cells, thereby decreasing drag. However, this is an optional design feature. Note that even where cells of the fan proximal structure that are closer to the fan effect a lower resistance-per-area to flow therethrough than do cells of the fan proximal structure that are further from the fan (which may be a result of some of the simpler designs that use latitudinal and longitudinally disposed structures that are of the same depth), which may result from a simpler, easier to manufacture design, such design is still within the ambit of the inventive technology and still may meet stated objectives of the inventive technology (perhaps simply because overall, the fan proximal structure still encourages more flow through the lower resistance-per-area sector than through the distinct, fan proximal structure), and/or because such fan proximal structure may include flow deflectors that compensate (or over-compensate) for any tendency to encourage more flow through the portions of the fan proximal structure that are closest to the fan.

Note that the latitudinally arranged elements (such as the flow deflectors) may increase the axial component of flow entering the fan (perhaps via an inlet cone attached to and forming part of the fan) either by realigning flow through their respective cell (and thus making overall flow through the entire fan proximal structure have a greater component that is parallel the fan rotation axis), and/or by creating resistance to such flow (the second mechanism increasing the flow through the lower resistance-per-area sector (which may, but need not, be a hole)). As discussed, even in embodiments without flow deflectors, the shroud may increase flow through a lower resistance-per-area sector at the "pole" of the inlet surface, and such flow has a greater component that is parallel with the fan axis (so that overall, the total flow into the fan has a greater component that is parallel with the fan rotation axis). Regardless of whether flow deflectors are used, in effect, the inventive technology preferably increases the component of flow (flow into the inlet cone of the fan) that is in line with the axis of the fan (e.g., parallel to it) without creating turbulent eddies and separation cells (or unacceptable amounts thereof) that can create tonal noise when they impact the fan blades.

Note that a flow obstructer 40 may be established at the base of the shroud (proximally the fan) to help to prevent or reduce flow that is perpendicular to the axis of rotation from separating as it attempts to make a sharp turn into the inlet. This optional feature—the flow obstructer—may help to achieve the advantages of the inventive technology, such as reducing tonal noise without impairing fan performance and/or efficiency by an unacceptable amount.

Another aspect of the inventive technology—which does not necessarily include flow deflectors (or deflecting vanes), but certainly may—may be described as an inlet shroud for a fan that defines a fan rotation axis and a fan rotation plane, the apparatus including: a substantially annular shaped latticed structure 50 through which a first flow of air passes when the shroud is attached to the fan (and the fan is activated such that it's on, of course); and attachment componentry 51 for attaching the shroud to the fan (or other structure, such that it is securely positioned relative to the fan), wherein the substantially annular shaped latticed structure has a fan distal edge 52 that defines a hole (whether the edge is circular or not) through which a second flow of air passes when the shroud is attached in fixed position relative to the fan. The fan distal edge is the edge of the shroud that is furthest from, or nearly so (see FIG. 7), the fan rotation plane. The substantially annular shaped latticed structure may (but need not necessarily), through the use of flow deflectors, deflect the first flow of air so that it is more closely aligned with (including parallel to) the fan rotation axis than it would be in the absence the substantially annular shaped latticed structure. Further, the second flow of air (that flows through the hole defined by the fan distal edge of the substantially annular shaped latticed structure) may be increased (over what would be seen without the structure in place) merely by the presence of the substantially annular shaped latticed structure, because such structure will act as a sector of resistance, in response to which more air flow (as compared to the case where no structure is in place) will pass through the aforementioned hole 37. Such fan input flow redistribution may alone, by itself, help to achieve benefits of the inventive technology. When combined with flow realignment (e.g., via axial direction flow deflectors and/or radial direction flow deflectors), these goals may be achieved to an even greater degree.

Note that the term attachment componentry is very broad—while it certainly includes holes, and perhaps tabs on which the holes are located (holes for fasteners), it could even be just space on the proximal portion of the shroud that allows one to drill a hole through (so it can be fastened to a fan). It could also simply be a surface that allows for adhesive attachment to a fan, for example. It could be magnetic attachment. Note that the inventive technology, when attached in any manner such that it is configured to condition (i.e., change the condition of) or handle air entering the fan, is considered attached in some manner (often, but certainly not necessarily, that would involve attachment to a fan).

More particularly relative to the shape of the substantially annular shaped latticed structure, in certain embodiments, an annular portion 60 (of the substantially annular shaped latticed structure) that is most proximal the fan rotation plane may be said to define a first radius 61 and the hole (defined by the distal edge of the structure) may be said to define a second radius 62; the first radius may be larger than the second radius. Accordingly, when viewed from the side (i.e., with a line of sight that is normal to the axis of rotation of the fan), certain embodiments may have a sort of frusto-conical shape (see, e.g., FIGS. 1, 4 and 7). Note that such shapes, in addition to shapes that approximate the top portion of a volcano (even if rounded off) are considered substantially annular. Indeed, a structure is still substantially annular shaped even where it is not mirror symmetric in a plane that is parallel with the fan rotation plane, and that bisects the structure.

Note that, as mentioned, any of the embodiments disclosed herein may further include an (annular) flow obstructer 40 that may be established substantially at an (annular) portion on the shroud that is most axially proximal the fan rotation plane. In general, conventionally (without the inventive shroud attached), the flow near the inlet cone is pulled perpendicular to the axis of the fan rotation and as it enters the cone it makes a fairly sharp turn to align itself (or better align itself) with the axis of rotation and enter the fan; eliminating or reducing this tightly curved flowpath is a possible, and likely, function of the wall at the base of the inventive inlet device. Indeed, blocking of the radial flow that would otherwise enter the fan inlet at the face of the inlet cone may be a goal of certain embodiments of the inventive technology, and may be achieved by the flow obstructor (e.g., a cylindrical wall) at the fan end of the apparatus (in certain embodiments). When an obstructor is used proximally the fan, the most proximal flow entering the shroud, nearest the fan, may tend to have a greater component in a direction that is parallel the fan rotation axis 6 (as explained, radial components of flow enter the fan may contribute to the problem of fan noise; reducing the magnitude of such components may reduce such fan-generated noise).

Any embodiments may also find benefit from the use of sound absorptive material (or acoustic treatment) 70 on and as part of flow deflectors (and perhaps other components, such as supports thereof, or the latticed structure, or shroud generally). Indeed, in certain embodiments, the entire shroud may be layered with acoustic material (perhaps applied to all the surfaces in order to interact with the acoustic energy coming from the fan); the flow deflect surface may actually be a surface of acoustic material. Note that absorptive material/acoustic treatment is inherently broad band. As mentioned, the inventive shroud (or latticed apparatus), in particular embodiments, reduces the so-called fan tone, which is the result of the interaction of the blades with some turbulent wakes. In some applications, acoustic treatment may be advisable if it does not reduce fan performance by an unacceptable degree. Note that one of the attractive features of embodiments of the inventive technology is that it does not reduce (by an unacceptably large amount) fan performance (e.g., in terms of pressure output, flow, or efficiency). While significant amounts of noise attenuation may be achieved merely by the inventive shroud (or latticed apparatus or structure), acoustic treatment used optionally on the shroud or latticed apparatus may further help to achieve additional noise attenuation, perhaps at frequencies other than the blade pass tone frequency. Note that the inventive technology, in particular embodiments, is, preferably, most effective at the blade pass tone.

Note that sound reduction may be achieved by reducing sound at the blade pass frequency (and perhaps harmonics thereof). Noise at the blade pass frequency is caused by: (1) fan blades cutting across wakes or turbulence entering the fan; and/or (2) pressure pulsations caused by the boundary layer wakes leaving the fan. Particular embodiments of the inventive technology disclosed herein may act on the first cause by making the flow entering the fan more uniform and by eliminating turbulent wakes. Such wakes may be eliminated by preventing the airflow from making sharp turns before entering the inlet of the fan. There may also be a noise reduction by reducing the scale of turbulent eddies that enter the fan. The disadvantage of this approach is the significant pressure loss as air passes through the grid. My invention has no significant impact on the performance of the fan.

Note that the fan tone (blade pass frequency) is often low frequency—125 to 250 hertz (as an exemplary range). The frequency is set by the number of blades and the rotational speed. For example, a 9 blade fan spinning at 1800 rpm would have a blade pass frequency of 9×(1800 rev/min)/(60 sec/min)=270 hertz. A thin absorptive layer (see, e.g., FIG. 7)—a type of acoustic treatment—that one could put on the surfaces of the invention could reduce predominantly high frequency sound (2000 hertz or higher).

As alluded to above, inventive methods are also considered as being within the ambit of the inventive technology. They may involve steps such as "establishing" (which may include simply manufacturing), and passing flow through an indicated sector(s), for example. Particular embodiments of the inventive method technology may track, or correlate with certain apparatus embodiments.

Note that any of the various aspects of the inventive technology may be sold attached to a fan (or in a kit alongside a fan), or instead may be sold alone so that they may be retrofitted onto a fan. Note also that the fans that may find application of the inventive technology described herein include but are not necessarily limited to propeller fans and radial fans.

Various embodiments may achieve goals simply by improving the flow into the fan, perhaps, at least in part, by flow redirection, reducing flow separation, avoiding or reducing the creation of additional wakes in fan input flow, reducing tangential flow (input flow that is perpendicular to the fan axis of rotation and that is typically near the base of the fan on the inlet side, in the area where the shroud may attach; see, e.g., FIG. 7), effecting redistribution of input flow (e.g., increasing the amount of input flow at or through the area defined by the "pole" of the apparatus), realigning the streamlines of the fan inlet flow to the center of the fan inlet (i.e., such that they're more co-linear with, or parallel with, the fan axis of rotation), prevent or reduce flow separation as the flow in a conventional inlet cone tries to make a sharp turn at the outer edge of the inlet cone, and/or smoothing out the input flow. Accordingly, aspects of the inventive technology may reduce blade tone, but doing so in a way that does not impact (at least not to an unacceptable degree) fan performance and/or fan efficiency. Particular embodiments may generally improve fan flow, and achieve attendant disclosed herein advantages.

Figure 11:
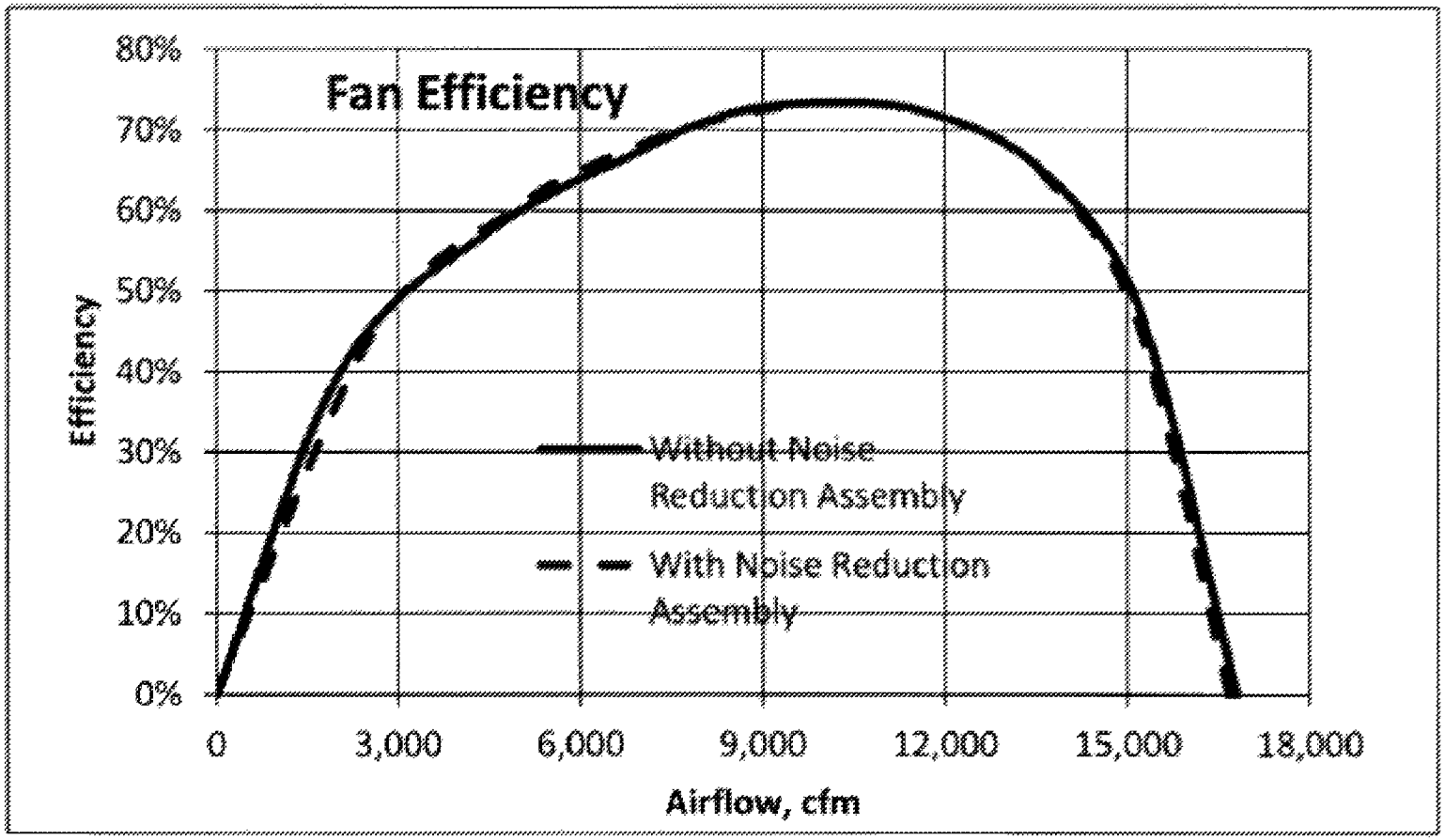
FIG. 11 shows a graph of fan efficiency observed with one embodiment of the inventive technology used on a fan.
Figure 12:
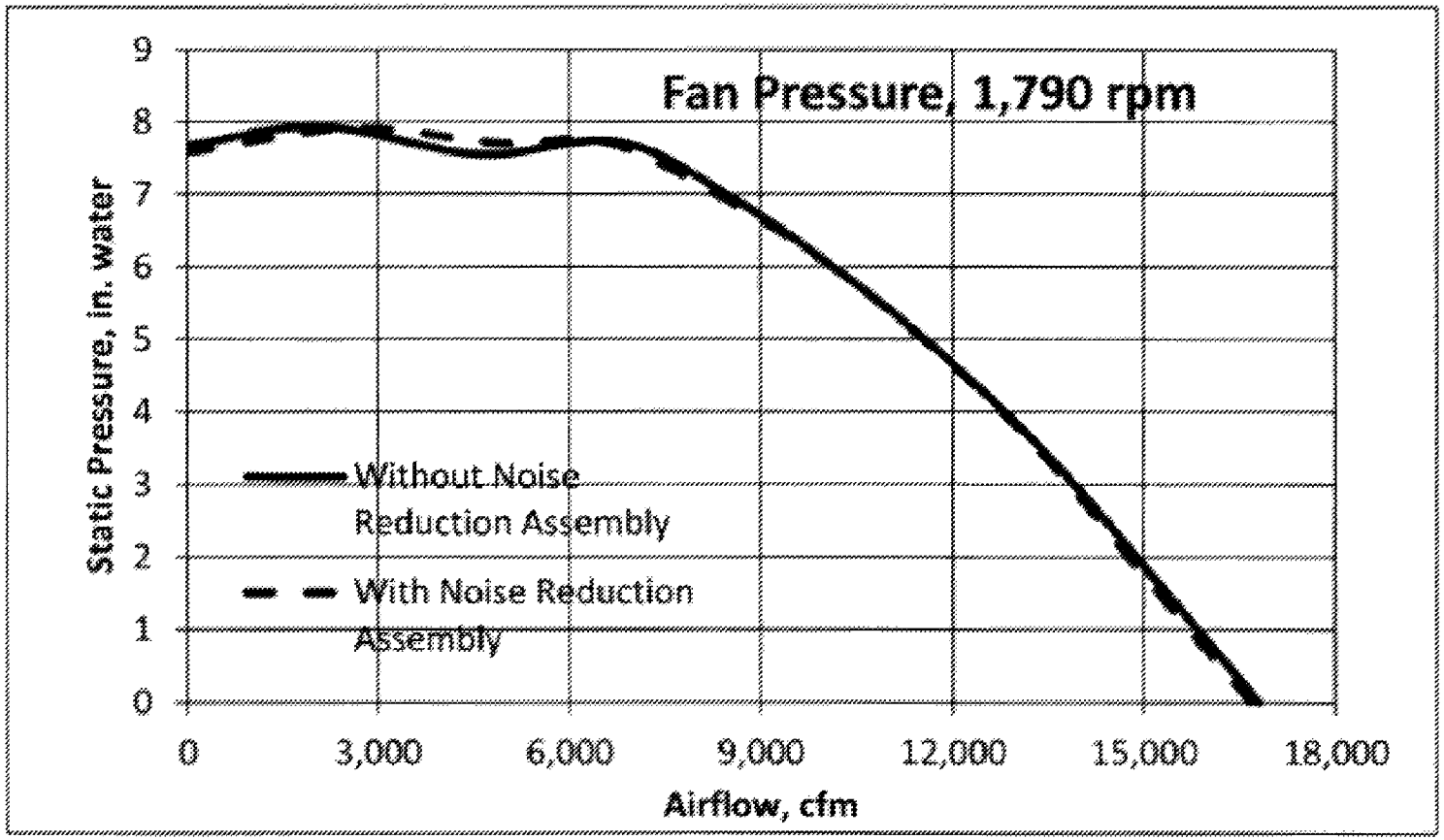
FIG. 12 shows a graph of fan static pressure observed with one embodiment of the inventive technology used on a fan.
Figure 13:
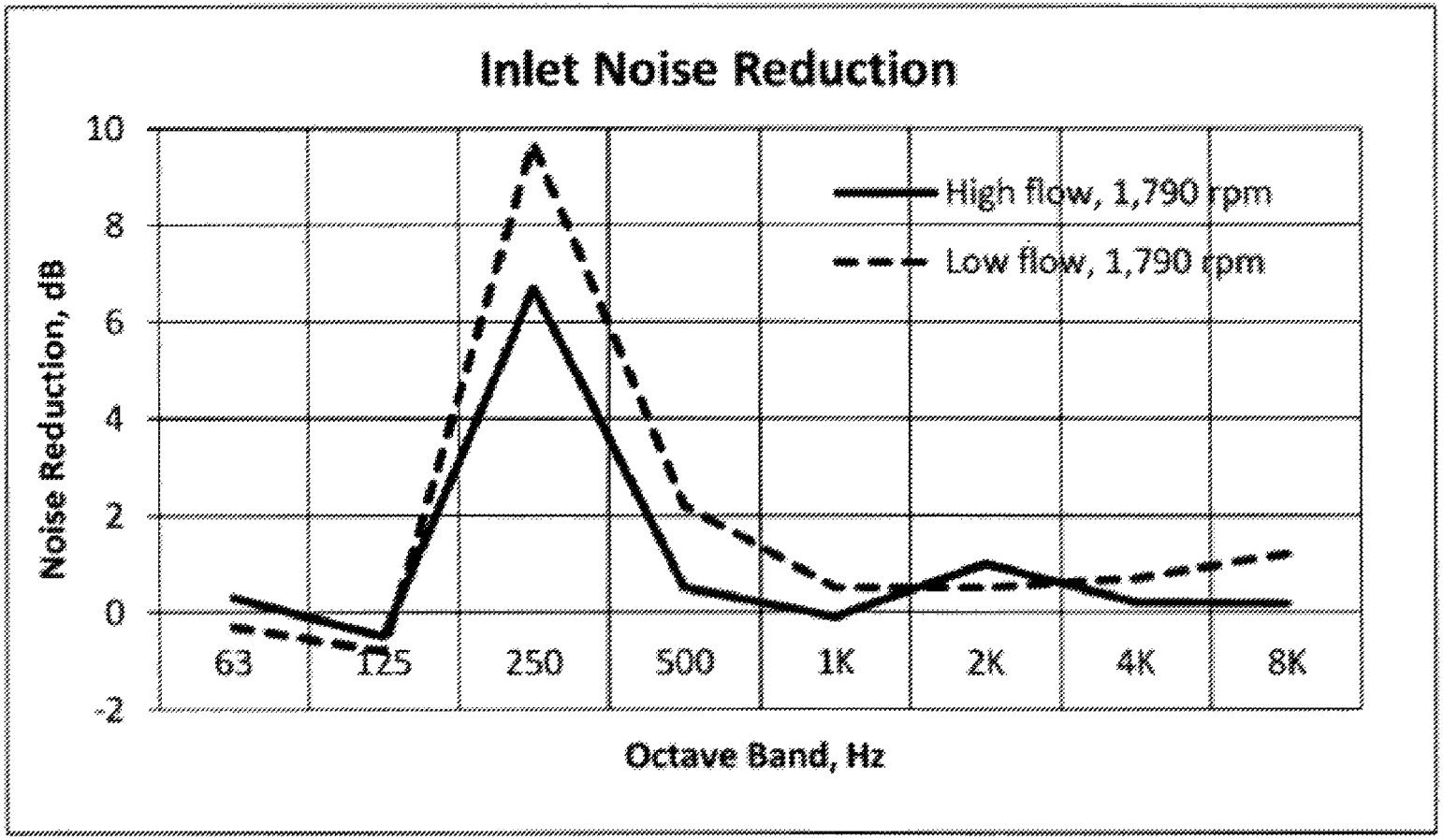
FIG. 13 shows a graph of the amount of noise reduction (for both high and low flow) effected upon use of an embodiment of the inventive technology used on a fan.

More particularly as to flow realignment cells, if the opening is too large the structure of that cell will not exert control over the entering air. However, if it is too small, it will increase the frictional losses to an unacceptable degree (via adding resistance posed by the additional structure) without improving the flow guidance. The optimal size may be viewed as just small enough (i.e., as large as possible), while still controlling (realigning and/or redistributing) the flow. As such, there would be minimal use of material and minimal resistance, while still achieving the goals of the invention. A balance may be achieved such that enough resistance on air flow is effected (caused) by the shroud, such that more flow is through a lower resistance sector, but not so much resistance that the sharp turn that would otherwise (i.e., without the shroud) be seen proximal the fan is simply re-located to just outside the distal edge of the shroud (further upstream of the fan). Determining such optimal size would be well within the ken of one of ordinary skill in the art and may depend on the particular application (note that well known tests for efficiency and performance (see FIGS. 11, 12 and 13) could be use to test different candidate designs for their negative impacts (if any) on fan performance and/or efficiency, and for their ability to achieve a desired degree of fan noise reduction). Note also that manufacture of any of the designed, inventive apparatus would be within the ken of one of ordinary skill in the art; exemplary manufacturing methods include injection molding, 3-D printing, laminate layup, material removal methods, as but a few examples. Materials that may be used include but are not limited to: plastic, fiberglass, recycled materials, laminate, and carbon (or other) fiber.

Additional Information: As can be easily understood from the foregoing, the basic concepts of the present invention may be embodied in a variety of ways. It involves both air flow handling techniques as well as devices to accomplish the appropriate handling. In this application, the handling techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this non-provisional application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "deflector" or "re-aligner" should be understood to encompass disclosure of the act of "deflecting" or "re-aligning"—whether explicitly discussed or not—and, conversely, were there effectively disclosure of the act of "deflecting" or "re-aligning", such a disclosure should be understood to encompass disclosure of a "deflector" and even a "means for deflecting", and of a "re-aligner" and even a "means for re-aligning." Such changes and alternative terms are to be understood to be explicitly included in the description. Further, each such means (whether explicitly so described or not) should be understood as encompassing all elements that can perform the given function, and all descriptions of elements that perform a described function should be understood as a non-limiting example of means for performing that function.

Any acts of law, statutes, regulations, or rules mentioned in this application for patent; or patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the air handling devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) an apparatus for performing the methods described herein comprising means for performing the steps, xii) the various combinations and permutations of each of the elements disclosed, xiii) each potentially dependent claim or concept as a dependency on each and every one of the independent claims or concepts presented, and xiv) all inventions described herein.

With regard to claims, whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim* v. *Cannon Avent Group*, PLC, 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 25 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A latticed apparatus configured for establishment at an inlet of a fan, comprising:

a latticed, fan-proximal structure that effects a first resistance-per-area to fan inlet flow passing therethrough and towards said fan, said fan-proximal structure extending upstream of said fan rotation plane and substantially surrounding a fan rotation axis; and a lower resistance-per-area sector that is further from said fan along said fan rotation axis than is said latticed, fan proximal structure, said lower resistance-per-area sector having a second resistance-per-area to fan inlet flow passing therethrough and towards said fan, wherein said first resistance-per-area is greater than said second resistance-per-area, wherein said latticed, fan proximal structure comprises:

a plurality of flow deflectors, each having a flow deflect surface, and each of said plurality of flow deflectors are established in a locationally different, respective flow realignment cell, wherein each said flow realignment cell is upflow of said fan rotation plane and radially outward from said fan rotation axis; and flow deflector supports that support said flow deflectors, wherein said flow deflectors each deflect incoming flow so that it is more closely aligned with said fan rotation axis, and wherein at least one of said flow deflectors is an axially distal flow deflector and is in a respective flow realignment cell that is radially outward from a point on said fan rotation axis that is an axially distal deflector distance from said fan rotation plane, wherein at least one of said flow deflectors is an axially proximal flow deflector and is in a respective flow realignment cell that is radially outward from a point on said fan rotation axis that is an axially proximal distance from said fan rotation plane, wherein said axially distal deflector distance is greater than said axially proximal distance, wherein said axially distal flow deflector has a respective flow deflect surface that forms a characteristic axially distal flow deflector angle with said fan rotation axis, wherein said axially proximal flow deflector has a respective flow deflect surface that forms a characteristic axially proximal flow deflector angle with said fan rotation axis, and wherein said characteristic axially distal flow deflector angle is less than said characteristic axially proximal flow deflector angle.

2. A latticed apparatus as described in claim 1 wherein said lower resistance-per-area sector comprises no structure.

3. A latticed apparatus as described in claim 2 wherein said lower resistance-per-area sector comprises a hole.

4. A latticed apparatus as described in claim 2 wherein said second resistance-per-area is substantially zero.

5. A latticed apparatus as described in claim 1 further comprising a fan-distal structure established within said lower resistance per area sector, said fan distal structure effecting said second resistance-per-area.

6. A latticed apparatus as described in claim 5 wherein said fan distal structure comprises lattice.

7. A latticed apparatus as described in claim 1 further comprising acoustic treatment on said latticed, fan proximal structure.

8. A latticed apparatus as described in claim 1 wherein said fan comprises a centrifugal fan.

9. A latticed apparatus as described in claim 1 wherein said fan comprises a propeller fan.

10. A latticed apparatus as described in claim 1 further comprising an annular flow obstructer established substantially at an annular portion on said latticed, fan-proximal structure that is most axially proximal said fan rotation plane.

11. A latticed apparatus as described in claim 1 wherein said latticed, fan-proximal structure has a partially hemispherical shape.

12. A latticed apparatus as described in claim 1 wherein said latticed, fan-proximal structure has a substantially hemispherical shape.

13. A latticed apparatus as described in claim 1 wherein said flow realignment cells each have a depth.

14. A latticed apparatus as described in claim 1 wherein said latticed, fan-proximal structure, when viewed from a point on said fan rotation axis that is further from said fan than is said lower resistance-per-area sector, shows said flow deflector supports as straight and extending radially outward from said fan rotation axis.

* * * * *